US011292273B2

(12) United States Patent
Sridhara et al.

(10) Patent No.: US 11,292,273 B2
(45) Date of Patent: Apr. 5, 2022

(54) LEADING EDGE DETECTION IN POS PRINTERS

(71) Applicant: TOSHIBA TEC KABUSHIKI KAISHA, Tokyo (JP)

(72) Inventors: Shreekeerthi Sridhara, Kranataka (IN); Geetha Patil, Kranataka (IN); Lochana Lingegowda, Kranataka (IN)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/071,985

(22) Filed: Oct. 15, 2020

(65) Prior Publication Data

US 2021/0291564 A1 Sep. 23, 2021

(30) Foreign Application Priority Data

Mar. 18, 2020 (IN) ..... 202041011757

(51) Int. Cl.

| | |
|---|---|
| ***B41J 11/00*** | (2006.01) |
| ***B41J 13/00*** | (2006.01) |
| ***G07G 5/00*** | (2006.01) |
| *G07F 19/00* | (2006.01) |

(52) U.S. Cl.

CPC ..... *B41J 11/0095* (2013.01); *B41J 13/0018* (2013.01); *G07G 5/00* (2013.01); *G07F 19/20* (2013.01)

(58) Field of Classification Search

CPC ..... B41J 11/0095; B41J 13/0018; G07G 5/00; G07F 19/20

See application file for complete search history.

(56) References Cited

U.S. PATENT DOCUMENTS 5,898,155 A * 4/1999 Imai ..... G07G 5/00 235/379

* cited by examiner

*Primary Examiner* — Henok D Legesse
(74) *Attorney, Agent, or Firm* — Foley & Lardner LLP

(57) ABSTRACT

A method and a printer for aligning leading edge of a printable receipt to print position of a printer is described. The printer includes a sensor placed proximal to a cutter position. The sensor generates a first signal in response to a printable receipt blocking the sensor. Upon detection of first signal from the sensor, a backward feed signal is provided to a first motor until the first signal is stopped to roll the printable receipt into a print receipt roller. Further, a forward feed signal is provided to the first motor to unroll printable receipt from the print receipt roller until a second signal is received from the sensor on blocking by the printable receipt. Upon detection of the second signal, an automatic fixed backward feed signal is provided to the first motor to align the leading edge of the printable receipt in the print position thereby avoiding wastage of printable receipt.

20 Claims, 5 Drawing Sheets

LEADING EDGE DETECTION IN POS PRINTERS

TECHNICAL FIELD

The present subject matter is generally related to printers and more particularly, but not exclusively, to a method and a printer for aligning leading edge of a printable receipt to a print position of a printer.

BACKGROUND

In a printer, a printable receipt is unrolled by a motor from a print receipt roller to print details of any transaction. Such printing process is executed by a print head provided in the printer, over a desired print area of the printable receipt. Upon completion of the printing process, the printable receipt is aligned to a cutter to cut at a position upstream of the print area of the printable receipt. The problem associated with such printers is that the printer, without verifying whether an excess printable receipt is pulled out during last cutting process, starts printing for subsequent transactions. As a result, a considerable quantity of printable receipts is wasted on daily basis, due to absence of a proper automatic alignment mechanism in such printers.

Further, in some scenarios the amount of rotations provided by the motor, may vary depending on transaction history and type of the printable receipt utilized in the printer. In such cases, unwanted slippage of the printable receipt may occur due to internal error of the motor. Moreover, excess forward feed may also happen due to wear and tear of the printer components utilized for unrolling. Consequently, unused printable receipts may be ejected beyond the cutter position of the printer resulting in such a waste of printable receipts.

The information disclosed in this background of the disclosure section is only for enhancement of understanding of the general background of the invention and should not be taken as an acknowledgement or any form of suggestion that this information forms the prior art already known to a person skilled in the art.

SUMMARY

The present disclosure discloses a method for aligning a leading edge of a printable receipt to print position of a printer. The method comprises detecting a first signal from a sensor placed proximal to a cutter position of the printer. The first signal is generated upon the printable receipt blocking the sensor. Thereafter, the method comprises providing a backward feed signal to a first motor of the printer upon detecting the first signal until the first signal is stopped. Upon receiving the backward feed signal, the first motor rolls the printable receipt into a print receipt roller of the printer. Once the first signal is stopped, the method further comprises providing a forward feed signal to the first motor until a second signal is received from the sensor. Upon receiving the forward feed signal, the first motor unrolls the printable receipt from the print receipt roller until the sensor generates the second signal due to blocking by the printable receipt. Thereafter, the method comprises providing an automatic fixed backward feed signal to the first motor upon detecting the second signal to align the leading edge of the printable receipt in the print position.

Further, the present disclosure discloses a printer. The printer comprises a sensor, a first motor and a control unit (controller). The sensor is placed proximal to a cutter position of the printer to generate a first signal upon a printable receipt of the printer blocking the sensor. The control unit is configured to detect the first signal from the sensor in response to the printable receipt blocking the sensor and provide a backward feed signal to the first motor of the printable receipt upon detection of the first signal until the first signal is stopped. Upon receiving the backward feed signal from the control unit, the first motor rolls the printable receipt into a print receipt roller of the printer. Further, the control unit provides a forward feed signal to the first motor until a second signal is received from the sensor. Upon receiving the forward feed signal from the control unit, the first motor unrolls the printable receipt from the print receipt roller until the sensor generates the second signal on blocking by the printable receipt. Thereafter, the control unit provides an automatic fixed backward feed signal to the first motor upon detection of the second signal to align the leading edge of the printable receipt in the print position.

Further the present disclosure comprises a non-transitory computer readable medium including instructions stored thereon that when processed by at least one control unit causes the control unit for aligning a leading edge of a printable receipt to a print position of a printer by performing a method comprising detecting a first signal from a sensor wherein the first signal is generated in response to the printable receipt blocking the sensor. Furthermore, the method comprises causing the control unit to provide a backward feed signal to a first motor of the printer upon detecting the first signal until the first signal is stopped wherein the printable receipt is rolled into a print receipt roller of the printer by the first motor upon receiving the backward feed signal. Further, the method comprises causing the control unit to provide a forward feed signal to the first motor until a second signal is received from the sensor wherein the second signal is generated in response to the printable receipt blocking the sensor wherein the printable receipt is unrolled from the print receipt roller by the first motor upon receiving the forward feed signal. Finally, the method comprises causing the control unit to perform to provide an automatic fixed backward feed signal to the first motor upon detecting the second signal.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE ACCOMPANYING DRAWINGS

The accompanying drawings, which are incorporated in and constitute a part of this disclosure, illustrate exemplary embodiments and, together with the description, explain the disclosed principles. In the figures, the left-most digit(s) of a reference number identifies the figure in which the reference number first appears. The same numbers are used throughout the figures to reference like features and components. Some embodiments of system and/or methods in accordance with embodiments of the present subject matter are now described, by way of example only, and regarding the accompanying figures, in which:

Figure 1A:
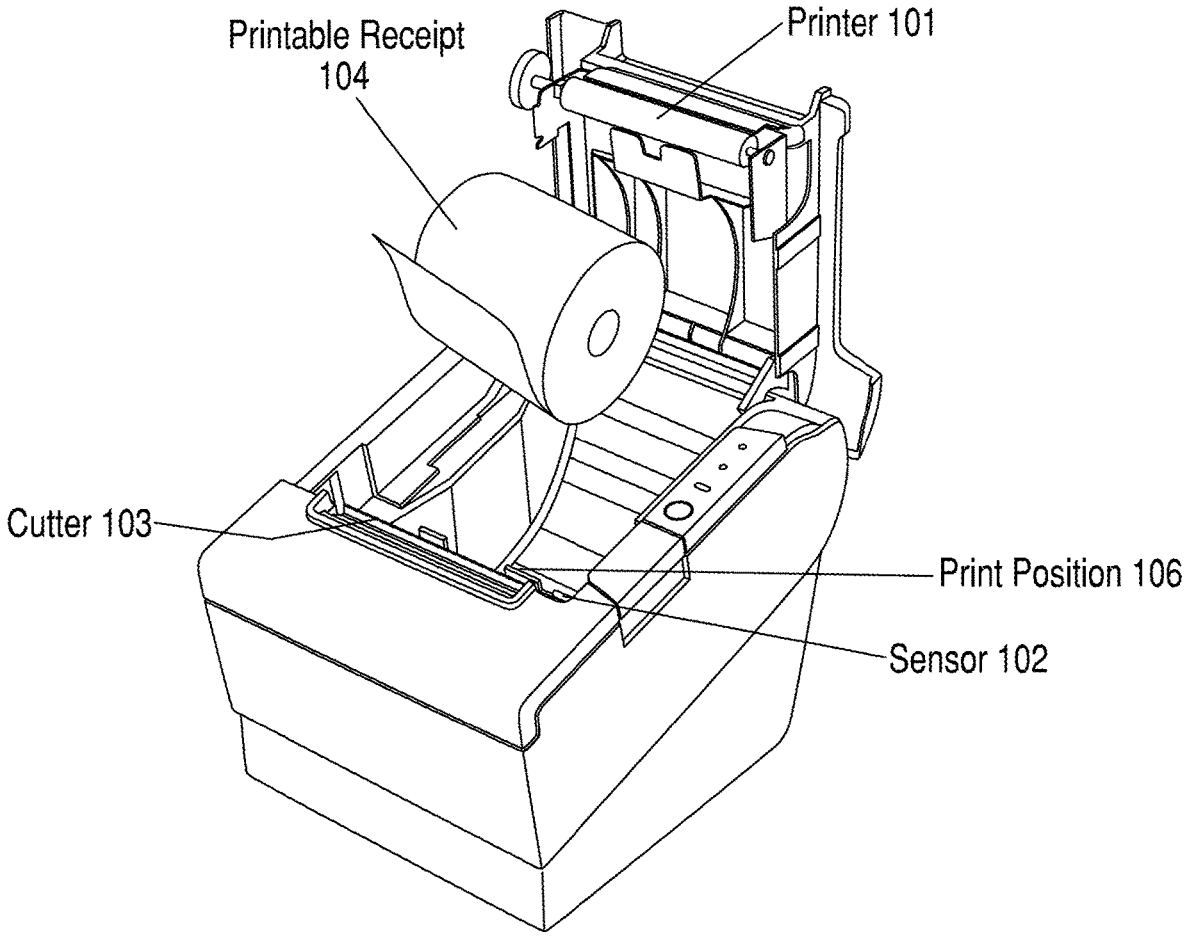
FIG. 1A and FIG. 1B shows exemplary views of a printer in accordance with at least one embodiment of the present disclosure.

It should be appreciated by those skilled in the art that any flow diagrams and timing diagrams herein represent conceptual views of illustrative device embodying the principles of the present subject matter. Similarly, it will be appreciated that any flow charts, flow diagrams, state transition diagrams, pseudo code, and the like represent various processes which may be substantially represented in computer readable medium and executed by a computer or processor, whether such computer or processor is explicitly shown.

DETAILED DESCRIPTION

In the present document, the word "exemplary" is used herein to mean "serving as an example, instance, or illustration." Any embodiment or implementation of the present subject matter described herein as "exemplary" is not necessarily to be construed as preferred or advantageous over other embodiments.

While the disclosure is susceptible to various modifications and alternative forms, specific embodiment thereof has been shown by way of example in the drawings and will be described in detail below. It should be understood, however that it is not intended to limit the disclosure to the specific forms disclosed, but on the contrary, the disclosure is to cover all modifications, equivalents, and alternative falling within the scope of the disclosure.

The terms "comprises", "comprising", "includes", "including" or any other variations thereof, are intended to cover a non-exclusive inclusion, such that a setup, device, or method that comprises a list of components or steps does not include only those components or steps but may include other components or steps not expressly listed or inherent to such setup or device or method. In other words, one or more elements in a system or apparatus proceeded by "comprises . . . a" does not, without more constraints, preclude the existence of other elements or additional elements in the system or method.

The present disclosure relates to a method and a printer for aligning a leading edge of a printable receipt to print position of a printer. At first, the printer may detect a first signal from a sensor placed proximal to a cutter position of the printer. The first signal is generated when the leading edge of the printable receipt is beyond the cutter position of the printer. Upon detecting the first signal, a backward feed signal may be provided to a first motor of the printer until the first signal is stopped. The backward feed signal may be provided for rolling the printable receipt into a print receipt roller of the printer until the first signal is stopped. Once the first signal is stopped, a forward feed signal may be provided to the first motor until a second signal is received from the sensor. The forward feed signal may be provided to unroll the printable receipt from the print receipt roller as the leading edge of the printable receipt may not be at the print position of the printer due to excess backward feed of the printable receipt. The first motor may unroll the printable receipt until the second signal is generated. The second signal is generated when the sensor is blocked by the printable receipt due to excess forward feed of the printable receipt. Thereafter, an automatic fixed backward feed signal may be provided to the first motor upon detecting the second signal. The fixed backward feed may be provided to align the leading edge of the printable receipt in the print position. In this manner, the printer aligns the leading edge of the printable receipt to the print position.

As mentioned above, due to the automatic control of backward feed and forward feed of the printable receipt to align the leading edge of the printable receipt to a print head position of the printer, wasting of printable receipt may be reduced. Further, due to automatic alignment of the leading edge of the printable receipt to print position, manual intervention is not required.

Figure 1B:
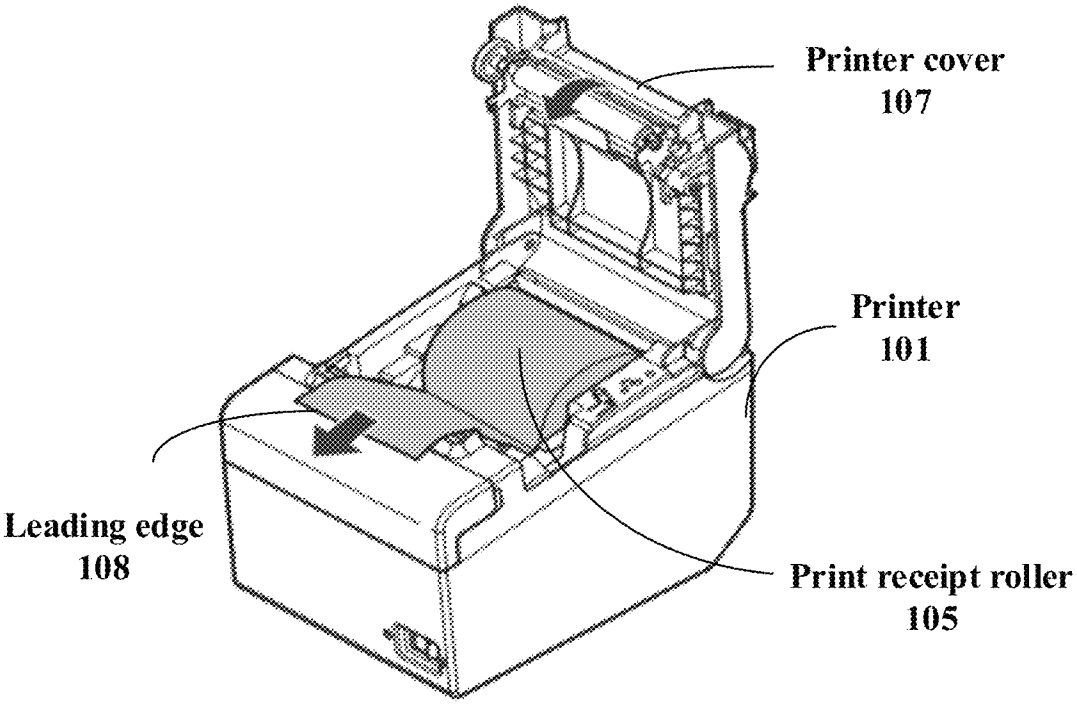

FIG. 1A and FIG. 1B shows exemplary views of a printer in accordance with at least one embodiment of the present disclosure.

As shown in FIG. 1A and FIG. 1B, the printer 101 may be a thermal printer, a barcode label printer, a Point of Sale (POS) receipt printer. Further, the printer 101 may be implemented in an Automated Teller Machine (ATM). In at least one embodiment, the printer 101 may comprise a sensor 102, a first motor 110 [shown in FIG. 1C], a second motor 111 [shown in FIG. 1C], a cutter 103, a print receipt roller 105 and a control unit 109 [shown in FIG. 1C]. The sensor 102 may be an analog sensor. The sensor 102 may be placed proximal to a cutter 103 position of the printer 101 as shown in FIG. 1A. The printer 101 also comprises a print position 106 at which the printable receipt 104 is printed. The print receipt roller 105 as shown in FIG. 1B may be configured to roll the printable receipt 104 for printing.

Figure 1C:
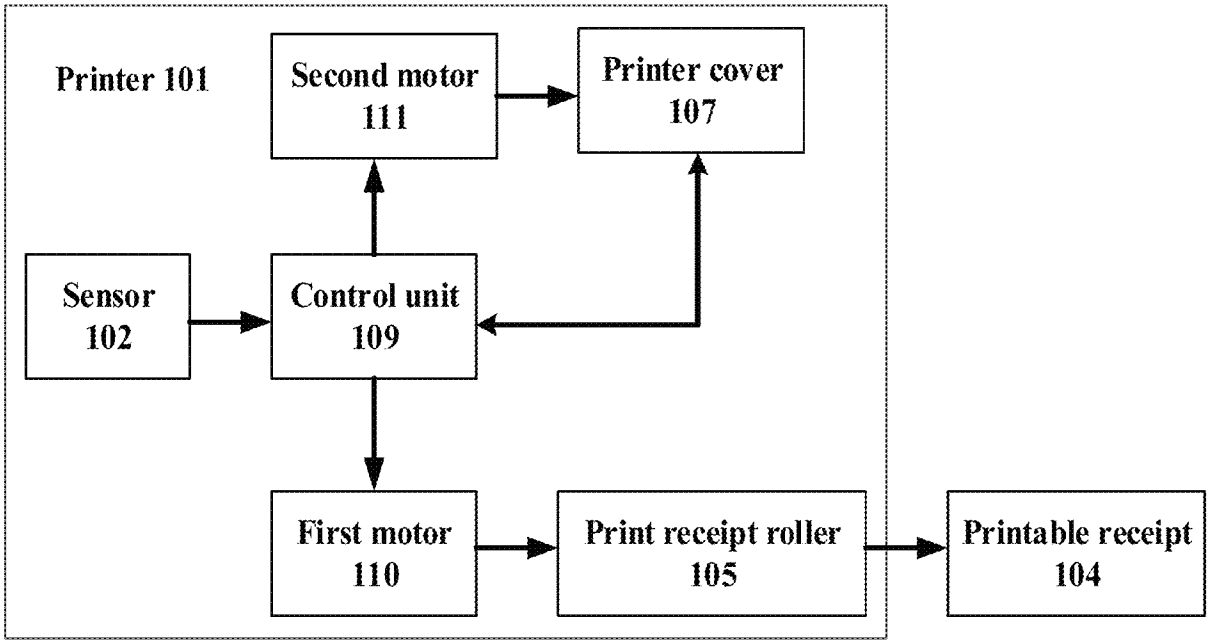
FIG. 1C shows a block diagram of a printer in accordance with at least one embodiment of the present disclosure.

FIG. 1C shows a block diagram of a printer in accordance with at least one embodiment of the present disclosure.

As shown in FIG. 1C, the sensor 102 of the printer 101 may be electrically connected to the control unit 109 of the printer 101 to control position of the leading edge 108 of the printable receipt 104. At first, the control unit 109 may receive a first signal from the sensor 102 when the printable receipt 104 blocks the sensor 102. The printable receipt 104 may block the sensor 102 when the printable receipt 104 is beyond the cutter 103 position. The first signal may be generated at boot up of the printer 101, each transaction of the printer 101 and when a printer cover 107 of the printer 101 is closed.

Upon detection of the first signal, the control unit 109 may provide a backward feed signal to the first motor 110 of the printer 101. Upon receiving the backward feed signal, the first motor 110 may roll the printable receipt 104 back into the print receipt roller 105 of the printer 101.

As a result of rolling back the print receipt into the roller, the printable receipt 104 may unblock the sensor 102. As a result, the sensor 102 may stop generating the first signal. When the first signal is stopped, the control unit 109 may stop providing the backward feed signal to the first motor 110. Consequently, the first motor 110 may stop rolling the printable receipt 104 back into the print receipt roller 105. By performing this action, the excess printable receipt 104 beyond the cutter 103 position may be rolled into the print receipt roller 105. However, while performing this action, there may be a situation wherein leading edge 108 of the printable receipt 104 may not be at the print position 106. Therefore, the control unit 109 may provide a forward feed signal to the first motor 110 of the printer 101 until a second signal is received from the sensor 102. The second signal may be generated by the sensor 102 when the printable receipt 104 blocks the sensor 102. Upon detection of the second signal from the sensor 102, the control unit 109 may provide a fixed backward feed signal to the first motor 110.

When the fixed backward feed signal is received, the first motor 110 may roll the printable receipt 104 into the print receipt roller 105 for a fixed number of steps which is predefined. This would enable the first motor 110 to roll the printable receipt 104 into the print receipt roller 105 in such a way that the leading edge 108 of the printable receipt 104 may be aligned with the print position 106.

In some embodiments, the first motor 110 may be configured to provide a backward feed at higher speed upon detection of the first signal, and to provide a subsequent forward feed or backward feed when the first signal is stopped, in order to accelerate the alignment of the leading edge 108 of the printable receipt 104 to the print position 106.

In some embodiments, the control unit 109 may send a control signal to the second motor 111 for lifting the printer cover 107 upon detection of the first signal. The second motor 111 may facilitate to lift the printer cover 107 up to a predefined distance upon receiving the control signal. Lifting the printer cover 107 may ensure avoidance of one or more damaged regions to the printable receipt 104 when the print receipt is rolled back into the roller by the first motor 110.

In some embodiments, once the first signal is stopped, a control signal may be transmitted to the second motor 111. Upon receiving the control signal, the second motor 111 may close the printer cover 107. Once the printer cover 107 is closed, a forward feed signal may be provided to the first motor 110 to unroll the printable receipt 104 from the print receipt roller 105.

In at least one embodiment, when the printer cover 107 is opened during the first signal from the sensor 102, the backward feed of printable receipt 104 may be performed at higher speed until the sensor 102 is unblocked. Thereafter the first motor 110 may be operated at lower speed in order to better position the printable receipt 104 at the print position 106.

Figure 2:
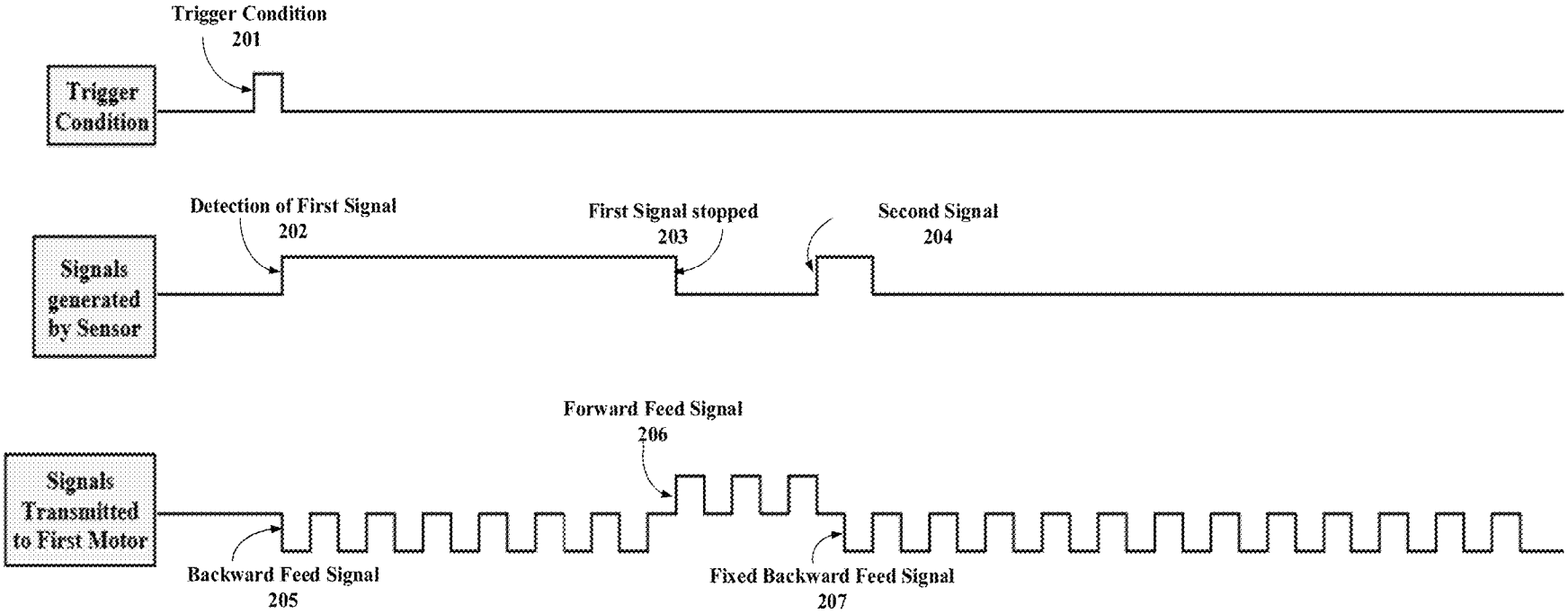
FIG. 2 shows a timing diagram for aligning a leading edge of a printable receipt to a print position of a printer in accordance with at least one embodiment of the present disclosure.

FIG. 2 shows a timing diagram for aligning leading edge of a printable receipt to a print position of a printer in accordance with some embodiments of the present disclosure.

As shown in FIG. 2, the trigger condition 201 may be detected when at least one of boot up of the printer 101, transaction of the printer 101 and when printer cover 107 of the printer 101 is closed from its open position. In one embodiment, the trigger condition 201 may be configurable at the printer 101 depending on user requirement. Thereafter, a first signal is detected from the sensor 102 if a printable receipt 104 blocks the sensor 102. When the first signal 202 is detected, a backward feed signal 205 may be provided to the first motor 110 of the printer 101 to roll the printable receipt 104 into a print receipt roller 105 of the printer 101. The backward feed signal 205 may be provided by the control unit 109. In at least one embodiment, the control unit 109 may provide a signal to a second motor 111 for lifting the printer cover 107 before providing the backward feed signal 205. When the printable receipt 104 unblocks the sensor 102, the first signal is stopped 203. Consequently, the backward feed signal 205 may be stopped to prevent any further movement of the printable receipt 104 into the print roller 105. In at least one embodiment, the control unit 109 may provide a signal to the second motor 111 for closing the printer cover 107 after the first signal 202 is stopped.

Further, a forward feed signal 206 may be provided to the first motor 110 when the first signal is stopped 203. The forward feed signal 206 may actuate the first motor 110 to unroll the printable receipt 104 from the print receipt roller 105 of the printer 101. Thereafter, a second signal 204 may be detected due to forward feed of the printable receipt 104, when the printable receipt 104 blocks the sensor 102 of the printer 101. As shown in FIG. 2 due to the second signal 204, a fixed backward feed signal 207 may be provided to the first motor 110 upon detection of the second signal 204 when the printable receipt 104 blocks the sensor 102. The first motor 110 may roll the printable receipt 104 into the print receipt roller 105 for a predefined number of steps to align the leading edge 108 of the printable receipt 104 to a print position 106. The print position 106 may correspond to the print head position 106 of the printer 101. In at least one embodiment upon detecting the leading edge 108 of the printable receipt 104 in the print position 106, the first motor 110 may stop rolling the printable receipt 104 into the print receipt roller 105.

In at least one embodiment, the speed at which the first motor 110 is operated for roll back of the printable receipt 104 after the first signal is higher than when roll back of the printable receipt 104 happens to align at the print position 106.

Figure 3:
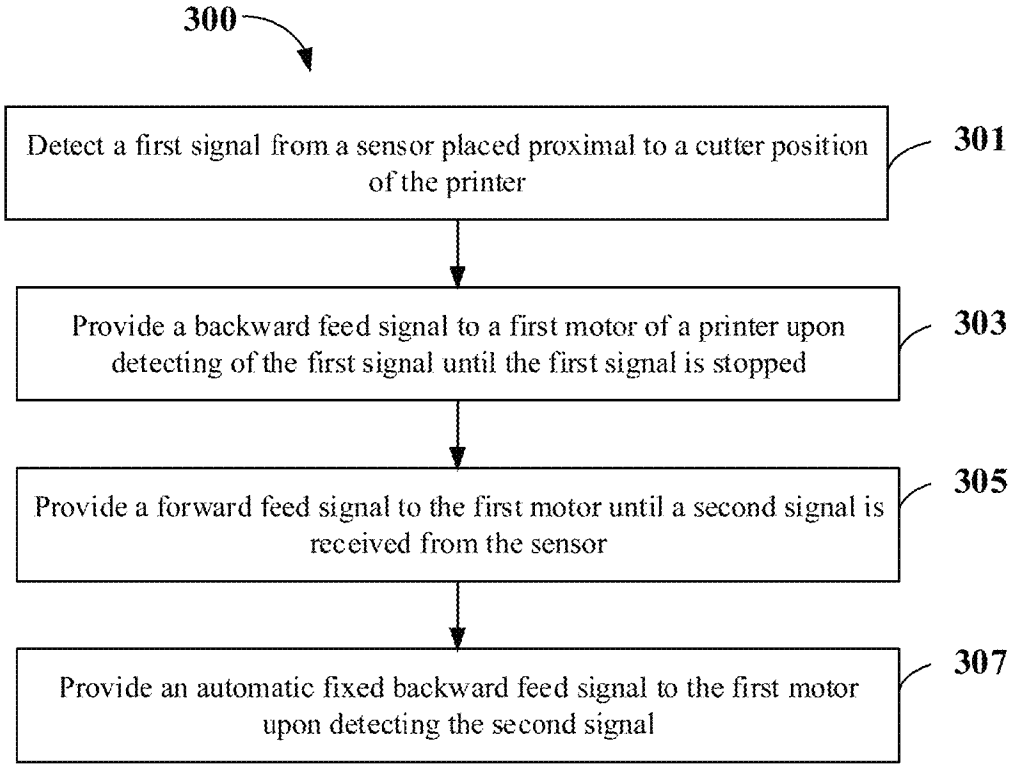
FIG. 3 shows a flowchart illustrating a method for aligning s leading edge of a printable receipt to print s position of a printer in accordance with at least one embodiment of the present disclosure.

FIG. 3 shows a flowchart illustrating a method for aligning leading edge of a printable receipt to print position of a printer in accordance with some embodiments of the present disclosure.

As illustrated in FIG. 3, the method 300 includes one or more blocks illustrating a method for aligning the leading edge 108 of a printable receipt 104 to the print position 106 of a printer 101. The order in which the method 300 is described is not intended to be construed as a limitation, and any number of the described method blocks can be combined in any order to implement the method. Additionally, individual blocks may be deleted from the methods without departing from the spirit and scope of the subject matter described herein. Furthermore, the method can be implemented in any suitable hardware, software, firmware, or combination thereof.

At block 301, the method may include detecting a first signal 202 from a sensor 102 which is placed proximal to a cutter 103 position of the printer 101. The first signal 202 may be generated when the printable receipt 104 blocks the sensor 102. The first signal 202 may be detected upon detecting a trigger condition 201 such as boot up of the printer 101, transaction of the printer 101 or when the printer cover 107 of the printer 101 is closed.

At block 303, the method may include providing a backward feed signal 205 to a first motor 110 of a printer 101 upon detecting the first signal 202. The backward feed signal 205 may be provided until the first signal 202 is stopped 203. Upon receiving the backward feed signal 205, the printable receipt 104 may be rolled into a print receipt roller 105 of the printer 101 by the first motor 110. In at least one embodiment, the backward feed signal 205 may be provided to the first motor 110 after lifting of a printer cover 107 of the printer 101. The printer cover 107 may be lifted by a second motor 111 of the printer 101. Upon receiving the backward feed signal 205, the first motor 110 may facilitate backward feed of the printable receipt 104.

At block 305, the method may include providing a forward feed signal 206 to the first motor 110 until a second signal 204 is received from the sensor 102. The second signal 204 may be detected 204 when the printable receipt 104 blocks the sensor 102. The printable receipt 104 may be unrolled from the print receipt roller 105 by the first motor 110 upon receiving the forward feed signal 206. The unrolling of the printable receipt 104 may be performed in order to provide the leading edge 108 of the printable receipt 104 at the print position 106. However, during the unrolling process, the printable receipt 104 may block the sensor 102 and hence the second signal is generated.

At block 307, the method may include providing an automatic fixed backward feed signal 207 to the first motor 110 upon detecting the second signal 204 to align the leading edge 108 of the printable receipt 104 in the print position 106. The print position 106 may be at print head 106 of the printer 101.

In at least one embodiment, the printable receipt 104 may be unrolled from the print receipt roller 105 at a slower speed in contrast to speed of rolling into the print receipt roller 105.

Advantages of the embodiments of the present disclosure are illustrated herein.

In at least one embodiment, the present disclosure provides a method and a printer for aligning leading edge of a printable receipt to print position of the printer.

In at least one embodiment, the present disclosure provides a method for automatically controlling backward feed and forward feed of the printable receipt to align the leading edge of the printable receipt to print head position of the printer and hence reduce waste of the printable receipt.

In at least one embodiment, in the present disclosure, the leading edge of the printable receipt is automatically aligned to print position and hence manual intervention is not required.

In at least one embodiment, the present disclosure utilizes a second motor to lift a printer cover of the printer before providing backward feed of the printable receipt, which avoids damage of printable receipts during rolling operation.

In at least another embodiment, the present disclosure utilizes the second motor to close the printer cover of the printer before providing forward feed of the printable receipt, which avoids printer jam and subsequent damage of the printable receipt during unrolling operation.

The terms "an embodiment", "embodiment", "embodiments", "the embodiment", "the embodiments", "one or more embodiments", "some embodiments", and "one embodiment" mean "one or more (but not all) embodiments of the invention(s)" unless expressly specified otherwise.

The terms "including", "comprising", "having" and variations thereof mean "including but not limited to", unless expressly specified otherwise. The enumerated listing of items does not imply that any or all the items are mutually exclusive, unless expressly specified otherwise.

The terms "a", "an" and "the" mean "one or more", unless expressly specified otherwise.

A description of an embodiment with several components in communication with each other does not imply that all such components are required. On the contrary, a variety of optional components are described to illustrate the wide variety of possible embodiments of the disclosure.

When a single device or article is described herein, it will be clear that more than one device/article (whether they cooperate) may be used in place of a single device/article. Similarly, where more than one device or article is described herein (whether they cooperate), it will be clear that a single device/article may be used in place of the more than one device or article or a different number of devices/articles may be used instead of the shown number of devices or programs. The functionality and/or the features of a device may be alternatively embodied by one or more other devices which are not explicitly described as having such functionality/features. Thus, other embodiments of the invention need not include the device itself.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based here on. Accordingly, the embodiments of the present invention are intended to be illustrative, but not limiting, of the scope of the disclosure, which is set forth in the following claims.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

Referral Numerals:

| Reference Number | Description |
|---|---|
| 101 | Printer |
| 102 | Sensor |
| 103 | Cutter |
| 104 | Printable receipt |
| 105 | Print receipt roller |
| 106 | Print position |
| 107 | Printer cover |
| 108 | Leading edge |
| 109 | Control Unit |
| 110 | First Motor |
| 111 | Second Motor |
| 201 | Detection of trigger condition |
| 202 | Detection of first signal |
| 203 | First signal stopped |
| 204 | Detection of second signal |
| 205 | Backward feed signal |
| 206 | Forward feed signal |
| 207 | Fixed backward feed signal |

What is claimed is:

1. A method for aligning a leading edge of a printable receipt to a print position of a printer, the method comprising:

detecting a first signal from a sensor, wherein the first signal is generated in response to the printable receipt blocking the sensor;

providing a backward feed signal to a first motor of the printer upon detecting the first signal until the first signal is stopped, wherein the printable receipt is rolled, by a backward feed, into a print receipt roller of the printer by the first motor upon receiving the backward feed signal;

providing a forward feed signal to the first motor until a second signal is received from the sensor, wherein the second signal is generated in response to the printable receipt blocking the sensor, wherein the printable receipt is unrolled, by a forward feed, from the print receipt roller by the first motor upon receiving the forward feed signal; and providing an automatic fixed backward feed signal to the first motor upon detecting the second signal.

2. The method as claimed in claim 1, wherein the print position is disposed at a print head of the printer.

3. The method as claimed in claim 1, wherein a speed of the backward feed of the printable receipt is greater than a speed of the forward feed of the printable receipt.

4. The method as claimed in claim 1, wherein the first signal is detected upon detecting a condition comprising at least one of boot up of the printer, transaction of the printer, or in response to a printer cover of the printer being closed.

5. The method as claimed in claim 1, wherein the backward feed signal is provided to the first motor upon lifting of a printer cover of the printer.

6. The method as claimed in claim 5, wherein the backward feed of the printable receipt is facilitated by lifting the printer cover of the printer by a predefined distance.

7. The method as claimed in claim 5 further comprising automatically closing the printer cover in response to the first signal being stopped.

8. The method as claimed in claim 1, wherein the sensor is disposed proximal to a cutter position of the printer.

9. A printer comprising:

a sensor configured to generate a first signal in response to a printable receipt of the printer blocking the sensor;

a first motor;

a controller configured to:

detect the first signal from the sensor in response to the printable receipt blocking the sensor;

provide a backward feed signal to the first motor of the printable receipt upon detection of the first signal until the first signal is stopped, wherein the first motor rolls the printable receipt, by a backward feed, into a print receipt roller of the printer upon receiving the backward feed signal;

provide a forward feed signal to the first motor until a second signal is received from the sensor, wherein the second signal is generated in response to the printable receipt blocking the sensor, wherein the first motor unrolls, by a forward feed, the printable receipt from the print receipt roller of the printer upon receiving the forward feed signal; and provide an automatic fixed backward feed signal to the first motor upon detection of the second signal.

10. The printer as claimed in claim 9 further comprising a second motor configured to:

lift a printer cover of the printer to facilitate backward feed of the printable receipt; and close the printer cover in response to the first signal being stopped.

11. The printer as claimed in claim 10, wherein the second motor is configured to lift the printer cover of the printer by a predefined distance to facilitate the backward feed of the printable receipt.

12. The printer as claimed in claim 9, wherein the controller is configured to detect the first signal upon detecting a condition comprising one of boot up of the printer, transaction of the printer, or in response to a printer cover of the printer being closed.

13. The printer as claimed in claim 9, wherein the sensor is disposed proximal to a cutter position of the printer.

14. The printer as claimed in claim 9, wherein the print position is disposed at a print head of the printer.

15. A non-transitory computer readable medium including instructions stored thereon that when processed by at least one controller causes the at least one controller to align a leading edge of a printable receipt to a print position of a printer by performing a method comprising:

detecting a first signal from a sensor, wherein the first signal is generated in response to the printable receipt blocking the sensor;

providing a backward feed signal to a first motor of the printer upon detecting the first signal until the first signal is stopped, wherein the printable receipt is rolled, by a backward feed, into a print receipt roller of the printer by the first motor upon receiving the backward feed signal;

providing a forward feed signal to the first motor until a second signal is received from the sensor, wherein the second signal is generated when the printable receipt blocks the sensor, wherein the printable receipt is unrolled, by a forward feed, from the print receipt roller by the first motor upon receiving the forward feed signal; and providing an automatic fixed backward feed signal to the first motor upon detecting the second signal.

16. The non-transitory computer readable medium as claimed in claim 15, wherein the method further comprises causing a second motor to:

lift a printer cover of the printer to facilitate backward feed of the printable receipt; and close the printer cover in response to the first signal being stopped.

17. The non-transitory computer readable medium as claimed in claim 16, wherein the method further comprises causing the second motor to lift the printer cover of the printer to a predefined distance to facilitate the backward feed of the printable receipt.

18. The non-transitory computer readable medium as claimed in claim 15, wherein the method further comprises causing the controller to detect the first signal upon detecting a condition comprising one of boot up of the printer, transaction of the printer, or in response to a printer cover of the printer being closed.

19. The non-transitory computer readable media as claimed in claim 15, wherein the print position is disposed at a print head of the printer.

20. The non-transitory computer readable media as claimed in claim 15, wherein the sensor is disposed proximal to a cutter position of the printer.

* * * * *